US005604816A

United States Patent [19]

Totani

[11] Patent Number: 5,604,816

[45] Date of Patent: Feb. 18, 1997

[54] VIBRATOR FOR PRODUCING A SENSIBLE VIBRATION

[75] Inventor: Tsutomu Totani, Nagoya, Japan

[73] Assignee: Kabushiki Kaisha Nippon Memorial, Nagoya, Japan

[21] Appl. No.: 393,690

[22] Filed: Feb. 24, 1995

Related U.S. Application Data

[63] Continuation-in-part of Ser. No. 917,573, Jul. 21, 1992, abandoned.

[30] Foreign Application Priority Data

Jul. 25, 1991 [JP] Japan ..... 3-66250 U

[51] Int. Cl.[6] ..... H04R 25/00

[52] U.S. Cl. ..... 381/199; 381/192

[58] Field of Search ..... 381/199, 194, 381/193, 207, 158, 192, 205, 188, 150, 152, 24, 86

[56] References Cited

U.S. PATENT DOCUMENTS 4,199,667 4/1980 Renner ..... 381/199
4,495,638 1/1985 Yamada et al. ..... 381/24

FOREIGN PATENT DOCUMENTS 0018296 1/1986 Japan ..... 381/199
0556137 9/1943 United Kingdom ..... 381/194

*Primary Examiner*—Curtis Kuntz
*Assistant Examiner*—Huyen D. Le
*Attorney, Agent, or Firm*—Koda and Androlia

[57] ABSTRACT

A vibrator for producing a sensible vibration synchronized with an electric signal which drives a speaker includes a casing having plural concavities provided in an inner wall thereof, a cylinder, a coil wound around the cylinder, a magnetic pole having an annular gap of such a required breadth as to have the coil inserted thereinto without contacting with the magnetic pole, and rubber elastic bodies securely provided in the concavities, and wherein the cylinder is fixed to the casing so that the coil is inserted into the gap, and magnetic pole is supported to the casing at its periphery by the rubber elastic bodies in such a manner to be radially and centrally displaceable and to be rotatable in the casing.

When current flows to the coil to generate a magnetic force, the magnetic pole displaces radially and rotates and then stops the radial displacement and rotation thereof to thereby provide a static state. In the static state, the weight of the magnetic pole and the elastic support force of the rubber elastic bodies and the magnetic force are balanced. In the balanced state, the magnetic pole reciprocates centrally to cause effective vibration.

4 Claims, 3 Drawing Sheets

VIBRATOR FOR PRODUCING A SENSIBLE VIBRATION

This is a continuation-In-Part of application Ser. No. 07/917,573, filed Jul. 21, 1992, now abandoned.

BACKGROUND OF THE INVENTION

This invention relates to a vibrator which may be attached to a seat, a bed, and the like and produces a sensible vibration synchronized With an electric signal which drives a speaker.

U.S. Pat. No. 4,495,638 discloses a vibrator of the type described in the present application. The conventional vibrator includes a casing, a cylinder, a coil wound around the cylinder, a magnetic pole having an annular gap of such a required breadth as to have the coil inserted thereinto so that the coil is out of contact with the magnetic pole, and an annular leaf spring. An outer-peripheral end of the annular leaf spring is fixed to an inner wall of the casing, while an inner-peripheral end of the annular leaf spring is fixed to an outer periphery of the magnetic pole. Thus, the magnetic pole is hung on the casing and the cylinder is fixed to the casing so that the coil is inserted into the annular gap without contacting with the magnetic pole.

With such a structure, when an electric signal flows to the coil, a magnetic interference generates between the magnetic pole and the coil to vibrate the casing, thereby giving a sensible vibration to a person sitting on a seat or a bed to which the case is attached .

In the conventional vibrator, the annular leaf spring is used to position the coil properly in the gap and support the magnetic pole to the casing in such a manner as to be displaceable just centrally.

According to this structure, the magnetic pole cannot almost displace radially. When current flows in the coil, generating a magnetic interference, a magnetic force acts on the pole in such a manner that the center of the annular gap corresponds to that of the coil, if a small difference occurs between the center of the coil and that of the annular gap. Thus, the load continue to act on the annular leaf spring radially. The reason is that the magnetic pole cannot substantially displace radially. This may lead to a metal fatigue of the annular leaf spring, so that the annular leaf spring comes to fail.

Further, the annular leaf spring is too rigid to convert the current signal to an effective vibration.

SUMMARY OF THE INVENTION

It is, accordingly, a primary object of the present invention to provide a vibrator which can ensure a high durability.

It is another object of the present invention to provide a vibrator which can ensure an effective vibration.

To attain the above objects, there is provided in the invention the vibrator for producing a sensible vibration comprising:

a casing having plural concavities provided in an inner wall thereof, a cylinder, a coil wound around the cylinder, a magnetic pole having an annular gap of such a required breadth as to have the coil inserted thereinto without contacting with the magnetic pole, and rubber elastic bodies securely provided in the concavities, and wherein: the cylinder is fixed to the casing so that the coil is inserted into the gap, and magnetic pole is supported to the casing at its periphery by the rubber elastic bodies in such a manner to be radially and centrally displaceable and to be rotatable in the casing.

According to the vibrator of the present invention, when current flows to the coil to generate a magnetic force, the magnetic pole displaces radially and rotates and then stops the radial displacement and rotation thereof to thereby provide a static state. In the static state, the weight of the magnetic pole and the elastic support force of the rubber elastic bodies and the magnetic force are balanced. In the balanced state, the magnetic pole reciprocates centrally to cause effective vibration. Therefore, the vibrator of the present invention is utilizable for a long period of time and the signal applied thereto can be converted to a vibration with high fidelity and low loss.

BRIEF DESCRIPTION OF THE DRAWING

With reference to the accompanying drawings.

DESCRIPTION OF THE PREFERRED EMBODIMENT

Figure 1:
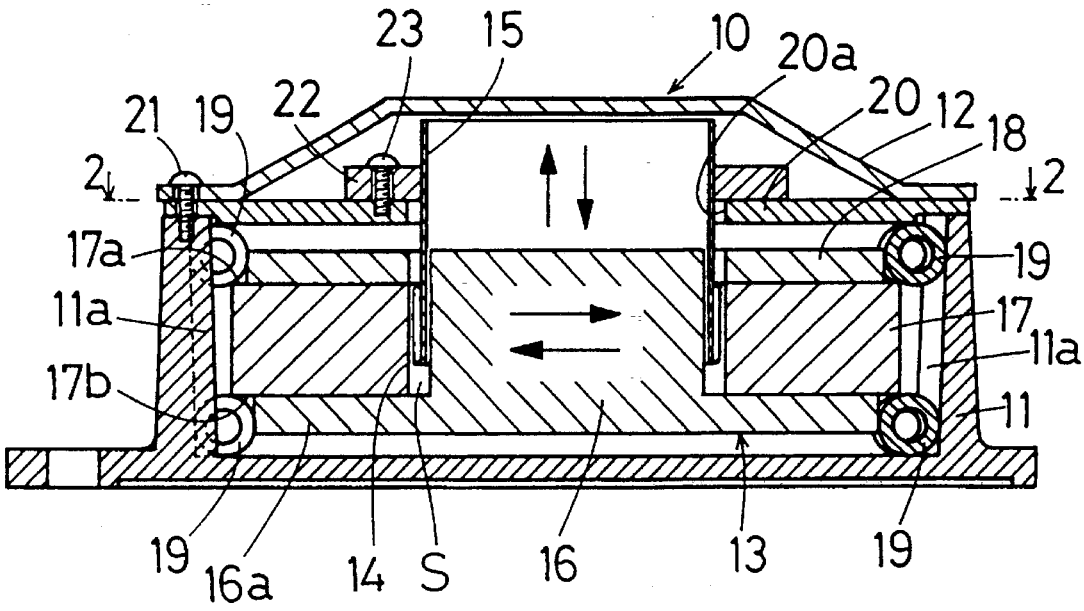
FIG. 1 is a sectional view illustrating a vibrator of the embodiment according to the invention.
Figure 2:
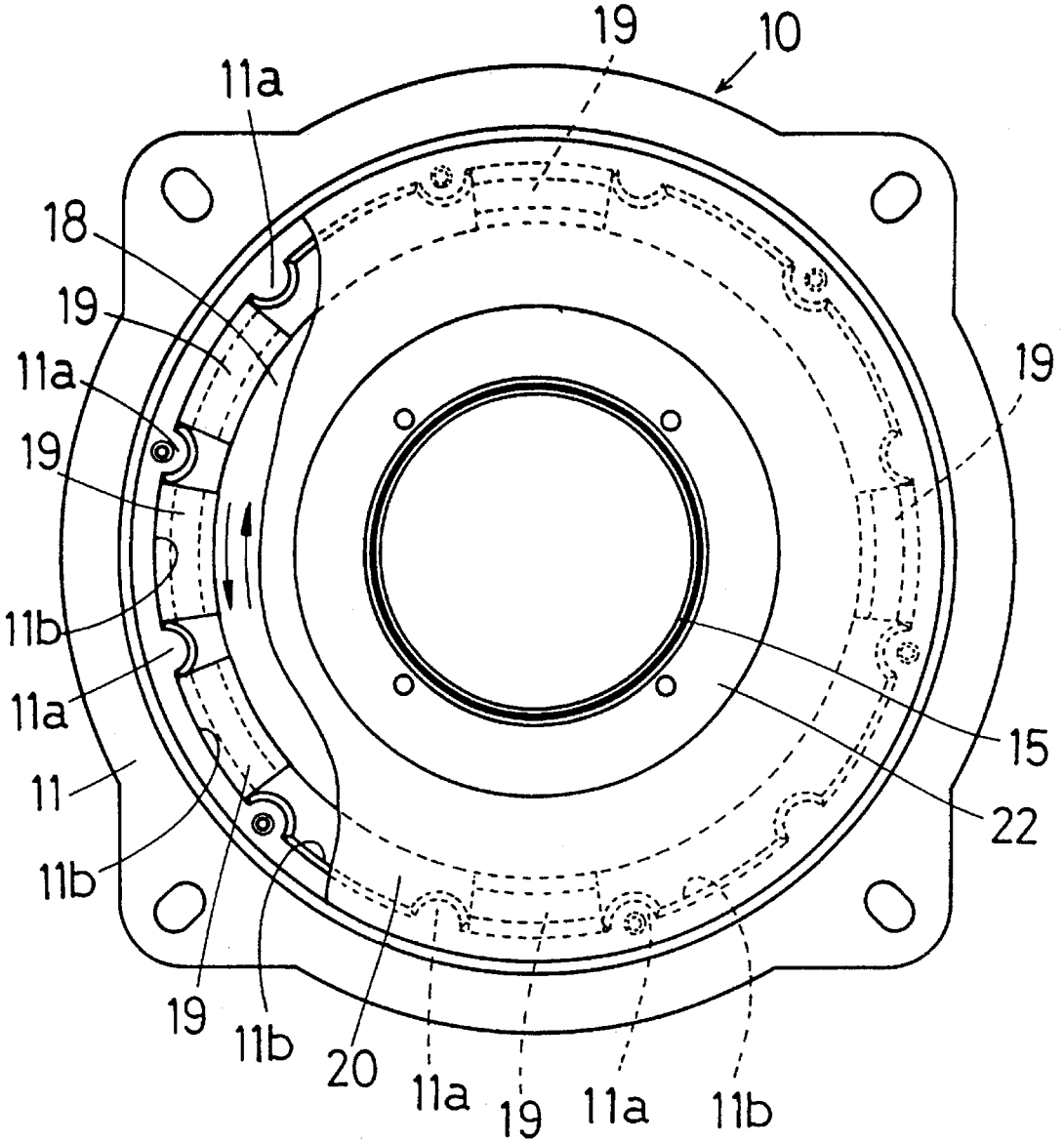
FIG. 2 is a plan view along line 2—2 of FIG. 1.

Referring now to FIG. 1 and FIG. 2, there are shown therein a vibrator 10 according to an embodiment of the invention.

The vibrator 10 comprises a bottomed casing 11 having an upper open end, a cover 12, a magnetic pole 13, rubber tubes 19 provided between an inner wall of the casing 11 and a periphery of the magnetic pole 13, a cylinder 15, a coil 14 wound around the cylinder 15, and an inner plate 20 formed with a hole 20*a* into which the cylinder 15 is to be inserted.

The magnetic pole 13 includes a column yoke 16 having a flange 16*a* formed in a lower end thereof, an annular magnet 17 mounted and bonded on the flange 16*a* to enclose the yoke 16, and an annular upper plate 18 bonded and fixed on an upper surface of the magnet 17, the yoke 16, the magnet 17, and the upper plate 18 assembled concentrically.

An outer diameter of the flange 16*a* and that of the upper plate 18 are designed to be slightly narrower than that of the magnet 17.

An outer periphery of the flange 16*a*, that of the upper plate 18, and an upper and a lower surface of the magnet 17, in combination, form annular steps 17*a* and 17*b*. An outer diameter of the yoke 16 is designed to be slightly narrower than an inner diameter of the magnet 17, so that an annular gap 13*a* is formed between the yoke 16 and the magnet 17, the gap 13*a* into which the coil 14 is to be inserted without contacting with the yoke 16 and the magnet 17.

Twelve convex stripes 11*a*, which have hemisphere cross section, are provided parallel to an axis of the casing 11 at equally angular intervals in an inner wall of the casing 11.

The adjacent convex stripes 11*a* form twelve groove concavities 11*b* therebetween. The groove concavities 11*b* extend from the upper open end of the casing 11 toward the bottom thereof.

Rubber tubes 19 are provided among the groove concavities 11*b* and the annular steps 17*a* and 17*b*.

The rubber tubes 19 are used to support the magnetic pole 13 to the casing 11 in such a manner to be radially and centrally displaceable and to be rotatable in the casing 11(see arrow marks in FIG. 1 and FIG. 2).

The rubber tubes 19 positioned at the open end of the casing 11 are held among the groove concavities 11*b*, the annular steps 17*a*, and the inner plate 20, while the inner plate 20 and the cover 12 are fixed to the open end of the casing 11 with a screw 21. Thus, the rubber tubes 19 at the open end are positioned and fixed to the casing 11.

Meanwhile, the rubber tubes 19 positioned at the bottom of the casing 11 are held among the groove concavities 11*b*, the annular steps 17*b*, and the bottom of the casing 11. Thus, the rubber tubes 19 at the bottom end are positioned and fixed to the casing 11.

The rubber tubes 19 are disposed densely or sparcely according to inner-wall sections of the casing 11, as illustrated in FIG. 2. In the present embodiment. The two rubber tubes 19 are inserted into the leftmost groove concavity 11*b* in FIG. 2 and the two adjacent upper and lower groove concavities, respectively.

Meanwhile, The two rubber tubes 19 are inserted into the rightmost groove concavity 11*b*, the uppermost groove concavity 11*b*, the lowermost groove concavity 11*b*, respectively. No rubber tubes are inserted into the other groove concavities.

The cylinder 15 is telescoped on the yoke 16 via the hole 20*a* while the coil 14 is inserted into the annular gap 13*a* of the magnetic pole 13 without contacting with the yoke 16 and the magnet 17. A ring plate 22, which is formed of insulation materials, is bonded and fixed on an upper periphery of the cylinder 15.

The ring plate 22 is also fixed to the inner plate 20 with a screw 23 to attach the cylinder 15 to the casing 11.

The vibrator 10 of the present embodiment is constructed as described above. When current flows to the coil to generate a magnetic force, the magnetic pole displaces radially and rotates, while the rubber tubes 19 deforms elastically and then stops the radial displacement and rotation thereof to thereby provide a static state. In the static state, the weight of the magnetic pole and the elastic support force of the rubber elastic bodies and the magnetic force are balanced. In the balanced state, the magnetic pole reciprocates centrally to cause effective vibration. Therefore, the vibrator of the present invention Is utilizable for a long period of time and the signal applied thereto can be converted to a vibration with high fidelity and low loss.

Figure 3:
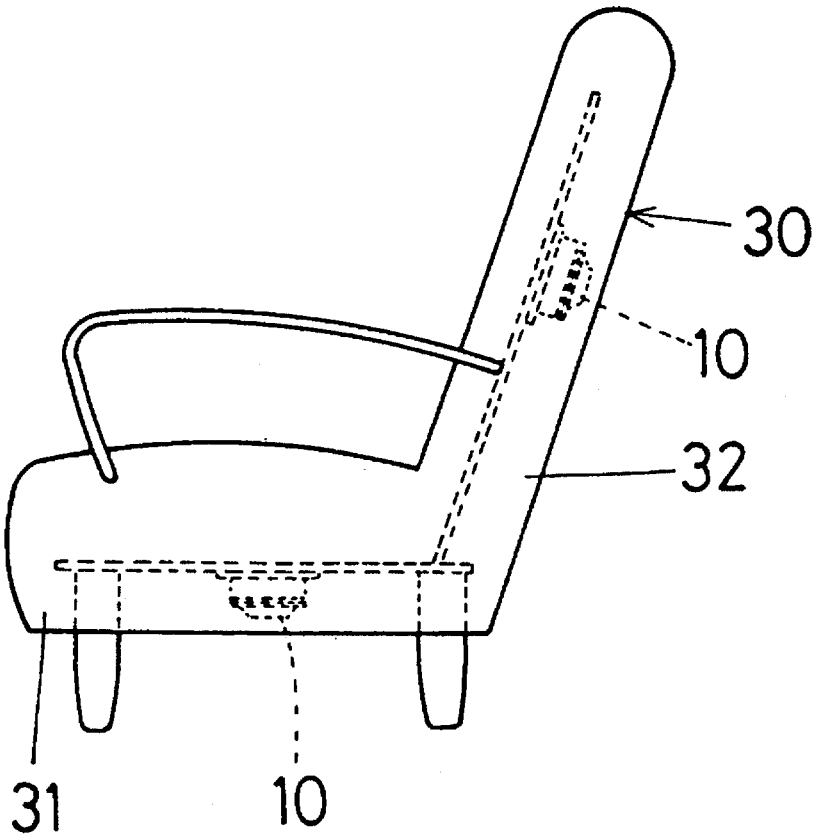
FIG. 3 is a side elevation view illustrating a seat to which the vibrator is attached.

The vibrator 10 of the present embodiment, the plural groove concavities 11*b* are provided in the inner wall of the casing 11 and the rubber tubes 19 removably inserted into the groove concavities 11*b* are used to support the magnetic pole 13 in the casing 11. According to this structure, the number or the hardness of the rubber tubes 19 can be changed according to the inner-wall sections of the casing 11 to adjust bearing powers of the rubber tubes 19. A illustrated in FIG. 3, for example, if the vibrator 10 is attached horizontally to a cushion 31 of a seat 30, the rubber tubes 19 are disposed uniformly in the inner wall of the casing 11. Meanwhile, if the vibrator 10 is attached to a back 32 of the seat 30, the more rubber tubes 19 are disposed on sections to be intensively influenced by the weight of the magnetic pole 13 than on the other sections in the inner wall of the casing 11.

As a result thereof, the magnetic pole 13 can be borne in a balanced condition relative to the casing 11 even if the casing 11 is attached obliquely to the seat 30 and the like. Thus, when the electric signal flows to the coil 14, an effective vibration generates. Further, equal forces acts at the each rubber tube 19, which ensures high-durability rubber tubes 19.

Also, in the present embodiment, the rubber tubes 19 are held between the groove concavities 11*b* and the periphery of the magnetic pole 13, thereby being fixed to the casing 11. As a result thereof, the assembly of the rubber tubes 19 becomes easy, which leads to a high productivity.

Further, of the plural groove concavities 11*b* formed at equally angular intervals, the appropriate groove concavities 11*b* can be selected easily, the concavities 11*b* into which the rubber tubes 19 are to be inserted, according to positions of attachment of the casing 11 to the seat and the like to adjust the bearing powers of the rubber tubes 19 for the magnetic poles 13.

Further, the annular step 17*a* and 17*b* are provided in the magnetic pole 13. The annular steps 17*a*, 17*b*, and the groove concavities 11*b* hold the rubber tubes 19 so that the rubber tubes 19 can be exactly positioned and fixed in the casing 11.

Also, the groove concavities 11*b* are formed into shapes which extend from the upper open end of the casing 11 toward the bottom thereof. Thus, it becomes easy to dispose the rubber tubes 19 in the open end and the bottom of the casing 11. This can facilitate the assembly and ensures a high productivity.

In the present embodiment, the rubber tubes 19 are used to bear the magnetic pole 13 in the casing 11. However, rubber balls and rubber blocks may be also employed for the rubber elastic bodies 19.

Further, in the present embodiment, the groove concavities 11*b* are provided on the inner wall of the casing 11 as concavities into which the rubber tubes 19 are to be inserted. However, the sizes and the shapes of the concavities 11*b* may be changed according to those of the rubber balls and the rubber blocks.

While the invention has been particularly shown and described with reference to preferred embodiments thereof, it will be understood by those skilled the art that the foregoing and other changes in from and details can be made therein without departing from the spirit and scope of the invention.

What is claimed is:

1. A vibrator for producing a sensible vibration, the vibrator comprising:

a casing having plural concavities provided in an inner wall thereof, a cylinder, a coil wound around the cylinder, a magnetic pole having an annular gap of such a required breadth as to have the coil inserted thereinto without contacting with the magnetic pole, and rubber elastic bodies securely provided in the concavities, and wherein:

the cylinder is fixed to the casing so that the coil is inserted into the gap, and the magnetic pole is supported to the casing at its periphery by the rubber elastic bodies such that said magnetic pole is radially and centrally displaceable and rotatable in the casing.

2. The vibrator as claimed in claim 1, wherein the concavities are provided at equal angular intervals in an inner wall of the casing.

3. The vibrator as claimed in claim 2, wherein annular steps are provided on the periphery of the magnetic pole and the annular steps and concavities hold the rubber elastic bodies so that the rubber elastic bodies are exactly positioned and fixed to the casing.

4. The vibrator as claimed in claim 3, wherein the concavities are formed into groove shapes extending from an upper open end of the casing toward a bottom thereof along an axis of the casing.

* * * * *